US011008826B2

(12) United States Patent
Scruggs

(10) Patent No.: US 11,008,826 B2
(45) **Date of Patent: *May 18, 2021**

(54) MULTIPLE SETTING AND UNSETTING OF INFLATABLE WELL PACKER

(71) Applicant: WEATHERFORD TECHNOLOGY HOLDINGS, LLC, Houston, TX (US)

(72) Inventor: Justin R. Scruggs, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 123 days.

This patent is subject to a terminal disclaimer.

(21) Appl. No.: 16/415,775

(22) Filed: May 17, 2019

(65) Prior Publication Data

US 2019/0271208 A1 Sep. 5, 2019

Related U.S. Application Data

(63) Continuation of application No. 15/831,659, filed on Dec. 5, 2017, now Pat. No. 10,544,647.

(51) Int. Cl.

| | |
|---|---|
| ***E21B 23/06*** | (2006.01) |
| ***E21B 33/127*** | (2006.01) |
| ***E21B 34/12*** | (2006.01) |
| ***E21B 34/08*** | (2006.01) |

(52) U.S. Cl.
CPC ..... *E21B 33/127* (2013.01); *E21B 34/08* (2013.01)

(58) Field of Classification Search
CPC .... E21B 33/127; E21B 33/1272; E21B 34/12; E21B 23/06
See application file for complete search history.

(56) References Cited

U.S. PATENT DOCUMENTS

| | | | | |
|---|---|---|---|---|
| 3,127,933 | A | 4/1964 | Graham et al. | |
| 3,419,074 | A | 12/1968 | Brown | |
| 3,503,445 | A * | 3/1970 | Cochrum | E21B 21/103 166/244.1 |
| 4,893,678 | A | 1/1990 | Stokley et al. | |

(Continued)

OTHER PUBLICATIONS

Baker Hughes; "Workover Systems", Completions and Production catalog No. 30373T, dated Nov. 2010, 28 pages.

(Continued)

*Primary Examiner* — Kenneth L Thompson
(74) *Attorney, Agent, or Firm* — Smith IP Services, P.C.

(57) ABSTRACT

An inflatable packer assembly can include an inflatable seal element having an internal inflation chamber, a flow passage extending longitudinally through the inflatable packer assembly, a flow restrictor between sections of the flow passage, and a flow controller that selectively permits and prevents fluid communication between the inflation chamber and each of the flow passage sections. The flow controller changes from a deflate configuration to an inflate configuration in response to an increase in flow rate through the flow passage. A method can include connecting an inflatable packer assembly in a tubular string, so that a longitudinal flow passage of the tubular string extends through the inflatable packer assembly, and a flow restrictor restricts flow between sections of the flow passage, and inflating an inflatable seal element of the inflatable packer assembly while fluid flows between the flow passage sections via the flow restrictor.

15 Claims, 8 Drawing Sheets

(56) References Cited

U.S. PATENT DOCUMENTS

| | | | | |
|---|---|---|---|---|
| 5,271,461 | A * | 12/1993 | Decker | E21B 23/006 166/185 |
| 5,499,687 | A * | 3/1996 | Lee | E21B 21/003 166/154 |
| 9,091,121 | B2 * | 7/2015 | Zhou | E21B 33/127 |
| 10,544,647 | B2 * | 1/2020 | Scruggs | E21B 33/127 |
| 2011/0094756 | A1 | 4/2011 | Corbett et al. | |
| 2017/0306716 | A1 * | 10/2017 | Hajjari | E21B 33/127 |

OTHER PUBLICATIONS

TAM International; "PosiFrac Multi-Set Inflatable Packer Straddle System", company catalog, dated Mar. 2015, 4 pages.
Weatherford; "Jet Frac Straddle System", catalog No. 2912.01, dated 2006, 2 pages.
TAM International; "TAM-J Multiple Set Inflatable Packer System", company catalog, dated Feb. 2011, 8 pages.
TAM International; "General Product Sheet—TAM-J Multiple Set Inflatable Packer System", company brochure, dated Oct. 2016, 2 pages.
Weatherford; "2-1/2 Retrievable Production Packer Assembly (STD)", drawing No. TT3730250005, dated Jan. 13, 2003, 1 page.
International Search Report with Written Opinion dated Feb. 22, 2019 for PCT Patent Application No. PCT/US2018/061412, 12 pages.

* cited by examiner

MULTIPLE SETTING AND UNSETTING OF INFLATABLE WELL PACKER

CROSS-REFERENCE TO RELATED APPLICATION

This application is a continuation of prior application Ser. No. 15/831,659 filed on 5 Dec. 2017. The entire disclosure of this prior application is incorporated herein by this reference.

BACKGROUND

This disclosure relates generally to equipment utilized and operations performed in conjunction with a subterranean well and, in an example described below, more particularly provides for repeated setting and unsetting of an inflatable packer in a single trip into a well.

An inflatable packer can be used to isolate sections of an annulus from each other in a well. The annulus may be formed between two tubular strings (such as, a tubing string and a casing or liner string), or between a tubular string and an uncased or open hole wellbore. An inflatable seal element of the packer is internally pressurized, causing it to expand radially outward and thereby seal off the annulus.

It will, thus, be readily appreciated that improvements are continually needed in the arts of designing, constructing and utilizing inflatable well packers. Such improvements can be useful in a wide variety of different well environments and configurations.

DETAILED DESCRIPTION

Figure 1:
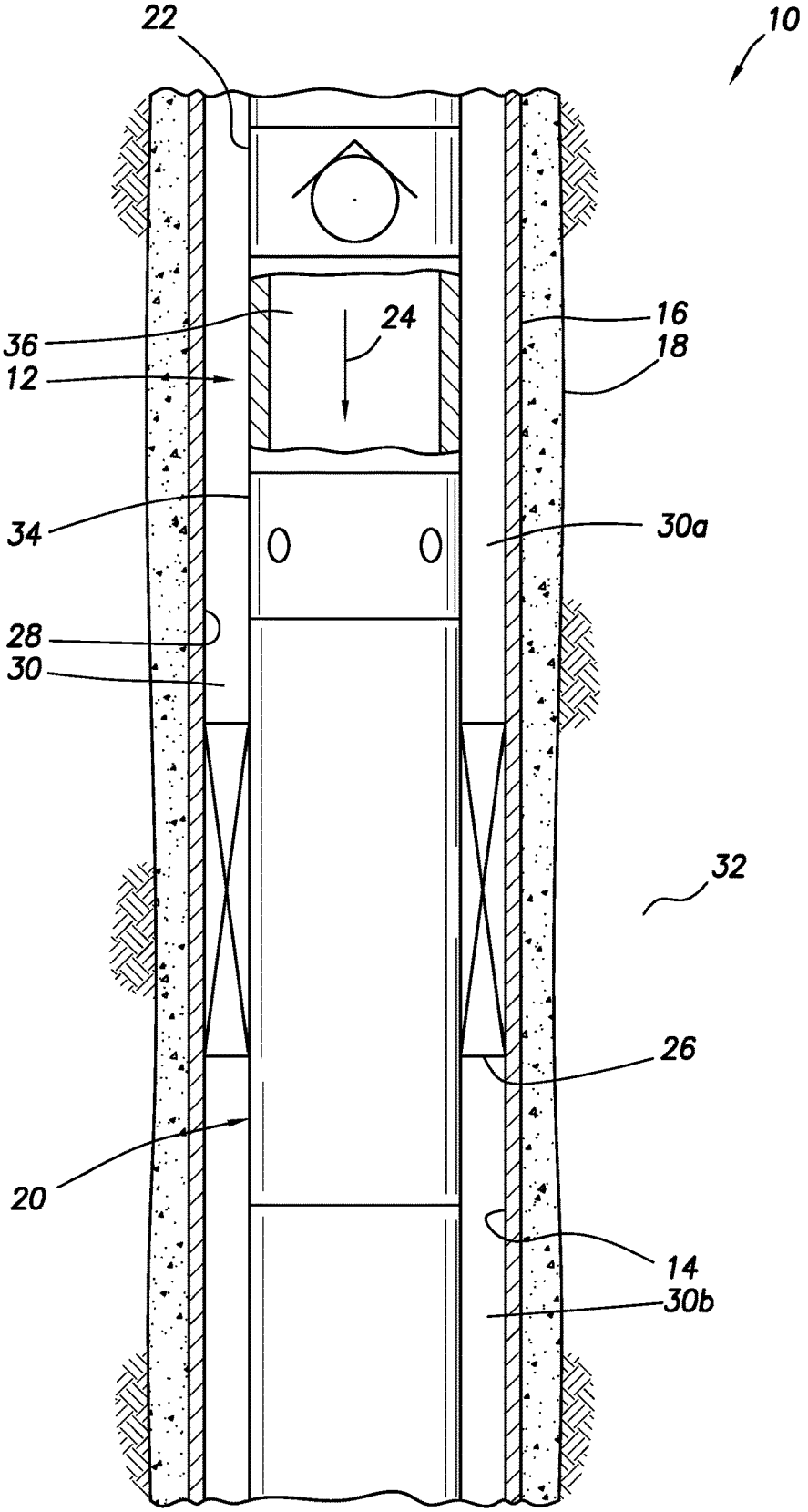
FIG. 1 is a representative partially cross-sectional view of an example of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned in a wellbore 14 lined with casing 16 and cement 18. In other examples, the tubular string 12 could be positioned in a section of the wellbore 14 that is uncased or open hole. In addition, the wellbore 14 is not necessarily vertical, but could instead be horizontal or otherwise deviated from vertical.

The tubular string 12 may be any of the types known to those skilled in the art as tubing (such as, segmented production tubing) or coiled tubing (substantially continuous tubing). The tubular string 12 may be made of any material or combination of materials (such as, steel, plastics, composites), and may include any combination of well tools connected therein. Thus, the scope of this disclosure is not limited to any particular details of the tubular string 12 as described herein or depicted in the drawings.

In the tubular string 12 example of FIG. 1, an inflatable packer assembly 20 is connected in the tubular string below (as viewed in FIG. 1) a check valve 22. The check valve 22 permits fluid flow 24 from surface downward through the tubular string 22, but prevents fluid flow in an opposite longitudinal direction toward the surface. The check valve 22 may be of the type known to those skilled in the art as a "pump-off" check valve, but other types of check valves may be used, and use of the check valve is not necessary, in keeping with the principles of this disclosure.

The packer assembly 20 includes an inflatable seal element 26 that is outwardly extendable into sealing engagement with a well surface 28. In this example, the well surface 28 is an interior surface of the casing 16, but if the wellbore 14 is uncased, the well surface could be an interior wall surface of an earth formation 32 penetrated by the wellbore. In other examples, the well surface 28 could be an interior surface of another type of tubular string (such as, a production tubing string or a liner string).

When the seal element 26 is sealingly engaged with the surrounding well surface 28, an annulus 30 outwardly surrounding the tubular string 12 is sealed off. Fluid communication between upper and lower sections 30*a,b* of the annulus 30 is prevented by the seal element 26.

To enable the packer assembly 20 to be set and unset multiple times in a single trip of the tubular string 12 into the wellbore 14, the packer assembly includes a flow controller 34. The flow controller 34 can be operated to inflate the seal element 26 using pressure in an internal longitudinal flow passage 36 of the tubular string 12, or to deflate the seal element by venting pressure in the seal element to the internal flow passage of the tubular string.

As depicted in FIG. 1, the packer assembly 20 is in a set configuration. The seal element 26 is inflated, so that it is outwardly extended and sealingly engages the well surface 28, thereby isolating the upper annulus section 30*a* from the lower annulus section 30*b*. Inflation pressure in the seal element 26 is isolated from the flow passage 36 and is otherwise prevented from venting by the flow controller 34.

As described more fully below, the flow controller 34 also isolates the upper annulus section 30*a* from the flow passage 36 in the set configuration. The upper annulus section 30*a* may be placed in fluid communication with the flow passage 36 in an inflate configuration (in which the flow controller 34 admits fluid from the flow passage 36 into the seal element 26) and in a deflate configuration (in which pressure in the seal element is vented to the flow passage 36).

In the method performed with the system 10, the packer assembly 20 is connected in the tubular string 12, and is installed with the tubular string into the wellbore 14 in the deflate configuration. In this configuration, the seal element 26 is not inflated, and is vented to the interior of the tubular string 12.

When the packer assembly 20 is appropriately positioned in the wellbore 14 and it is desired to set the packer assembly, a flow rate of the fluid flow 24 through the flow passage 36 is increased until it is at or above a predetermined level. The flow rate may be increased from no flow, or from a lower flow rate (such as, circulation flow through the tubular string 12), to the predetermined flow rate level.

Figure 2:
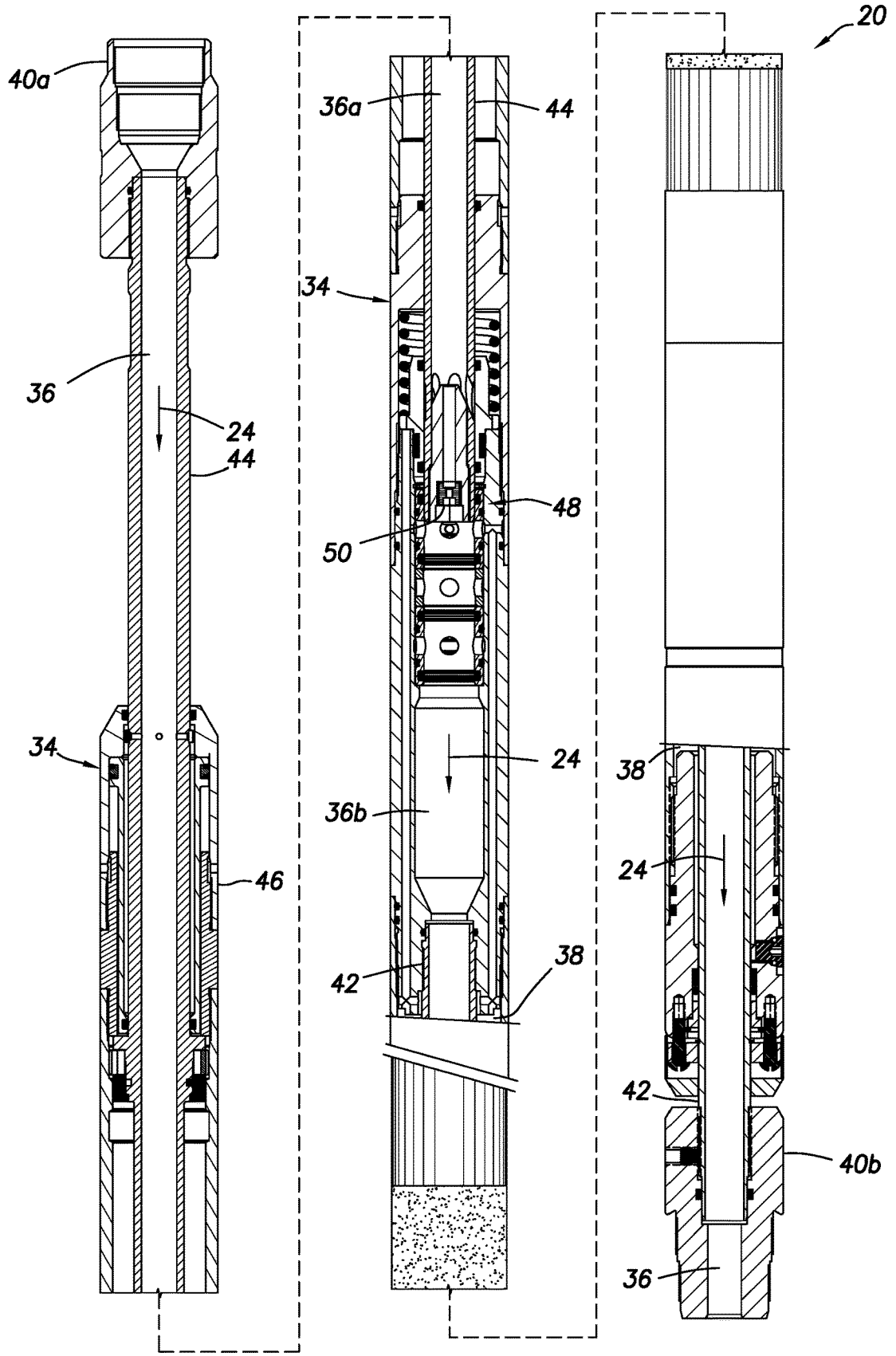
FIG. 2 is a representative partially cross-sectional view of an inflatable packer assembly that may be used in the system and method of FIG. 1, and which can embody the principles of this disclosure.

When the flow rate reaches the predetermined level, the flow controller 34 places the flow passage 36 in communication with an interior inflation chamber 38 of the seal element 26 (not visible in FIG. 1, see FIG. 2). A flow path from the flow passage 36 to the inflation chamber 38 is opened, thereby inflating the seal element 26 in this inflate configuration.

When the seal element 26 is satisfactorily inflated, the flow controller 34 isolates the inflation chamber 38 from the flow passage 36, thereby maintaining inflation pressure in the inflation chamber. The flow controller 34 is operated to this set configuration in response to longitudinally compressing the flow controller (e.g., by slacking off on the tubular string 12 at the surface, so that a weight of the tubular string is applied to the flow controller).

In the set configuration depicted in FIG. 1, a variety of different well operations may be performed which rely on the upper annulus section 30*a* being isolated from the lower annulus section 30*b*. For example, an integrity of the casing 16 below the seal element 26 can be tested by pressurizing the flow passage 36 (e.g., using a pump at the surface), with the flow passage 36 being in communication with the lower annulus section 30*b*.

After the lower annulus section 30*b* has been pressurized, a pressure decrease (detected, for example, by monitoring pressure in the flow passage 36 at the surface) can indicate leakage from the casing 16 below the seal element 26. Other tests, and other types of well operations, may be performed with the packer assembly 20 in the set configuration, in keeping with the principles of this disclosure.

The packer assembly 20 can be returned to the deflate configuration, for example, in order to permit conveyance of the packer assembly to another position in the wellbore 14, or to allow the packer assembly to be retrieved from the wellbore. The flow controller 34 is operated to the deflate configuration in response to longitudinally extending the flow controller (e.g., by picking up on the tubular string 12 at the surface, so that the weight of the tubular string is lifted from the flow controller).

Referring additionally now to FIG. 2, a cross-sectional view of an example of the inflatable packer assembly 20 is representatively illustrated. For convenience and clarity, the description herein of the packer assembly 20 relates to its use in the FIG. 1 system 10 and method, but it should be clearly understood that the packer assembly may be used in other systems and methods in keeping with the principles of this disclosure.

In the FIG. 2 example, the packer assembly 20 includes upper and lower connectors 40*a,b* for connecting the packer assembly in a tubular string (such as, the tubular string 12). As depicted in FIG. 2, the connectors 40*a,b* are threaded for coupling to similarly-threaded connectors of the tubular string 12, but other types of connectors (such as, latches, quick couplers, etc.) may be used in other examples.

The lower connector 40*b* is connected to the flow controller 34 with an internal tubular mandrel 42, such that the flow passage 36 extends through the seal element 26 between the flow controller 34 and the lower connector 40*b*. The inflation chamber 38 is formed radially between the seal element 26 and the mandrel 42.

When a pressure differential is created from the inflation chamber 38 to an exterior of the seal element 26 (e.g., the annulus 30 in the FIG. 1 system 10), the seal element is inflated and extends radially outward. When the pressure differential is subsequently relieved, the seal element 26 deflates and retracts radially inward. Thus, by controlling the pressure differential across the seal element 26 (between the inflation chamber 38 and the exterior of the seal element), the packer assembly 20 is changed between its deflate, inflate and set configurations.

Another internal tubular mandrel 44 connects the upper connector 40*a* to the flow controller 34, such that the flow passage 36 extends through an actuator 46 and a flow director 48 of the flow controller. A lower end of the mandrel 44 is slidingly and sealingly received in the flow director 48. In addition, the lower end of the mandrel 44 has a flow restrictor 50 therein that restricts the fluid flow 24 from an upper section 36*a* of the flow passage 36 to a lower section 36*b* of the flow passage.

As described more fully below, a position of the mandrel 44 in the flow director 48 determines whether fluid communication is permitted: between the upper flow passage section 36*a* and the inflation chamber 38, between the lower flow passage section 36*b* and the inflation chamber 38, and between the lower flow passage section 36*b* and the exterior above the seal element 26 (e.g., the upper annulus section 30*a* in the FIG. 1 system 10).

Figure 3:
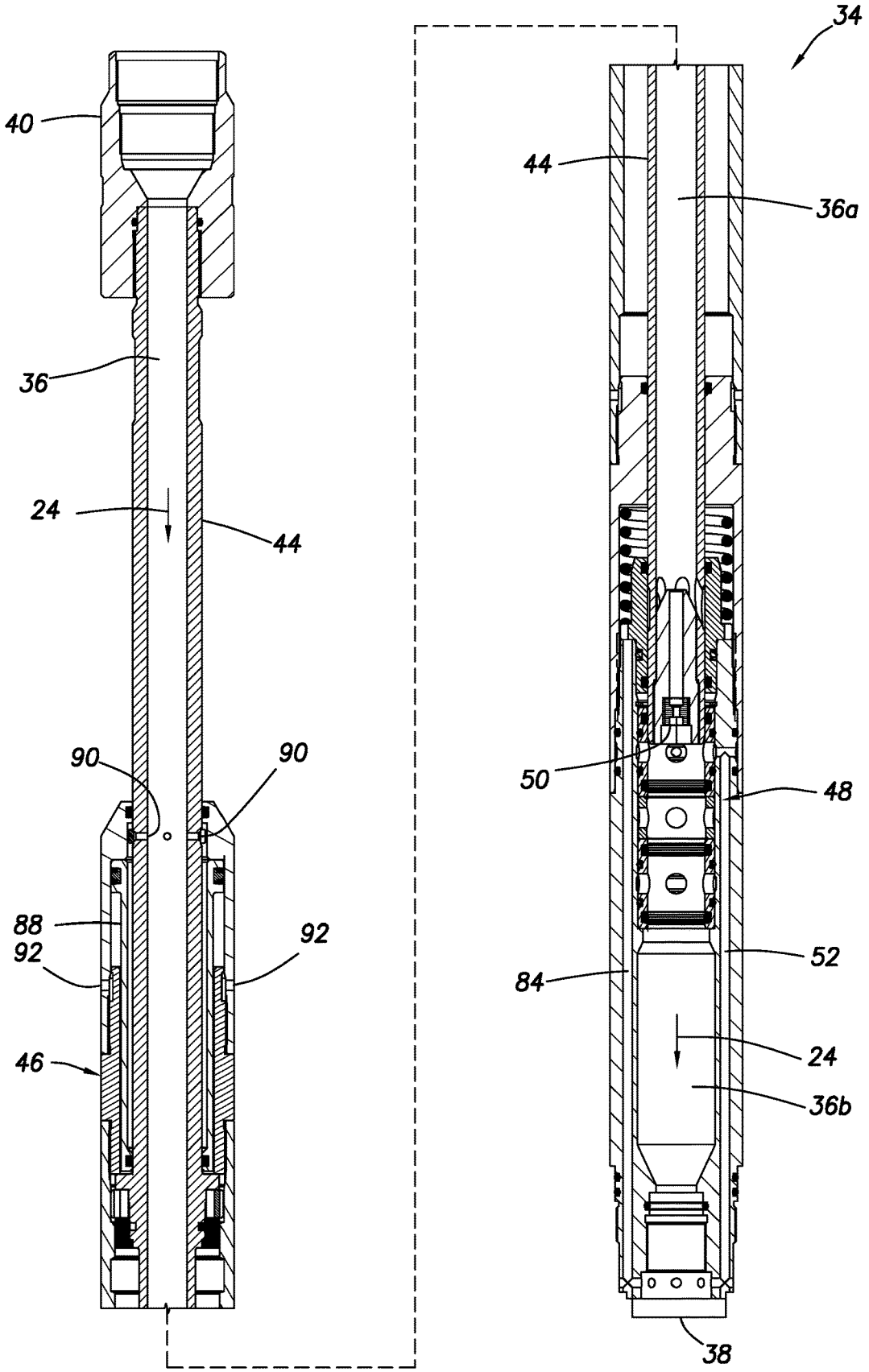
FIG. 3 is a representative cross-sectional view of a flow controller of the inflatable packer assembly in an example of a deflate configuration.
Figure 4:
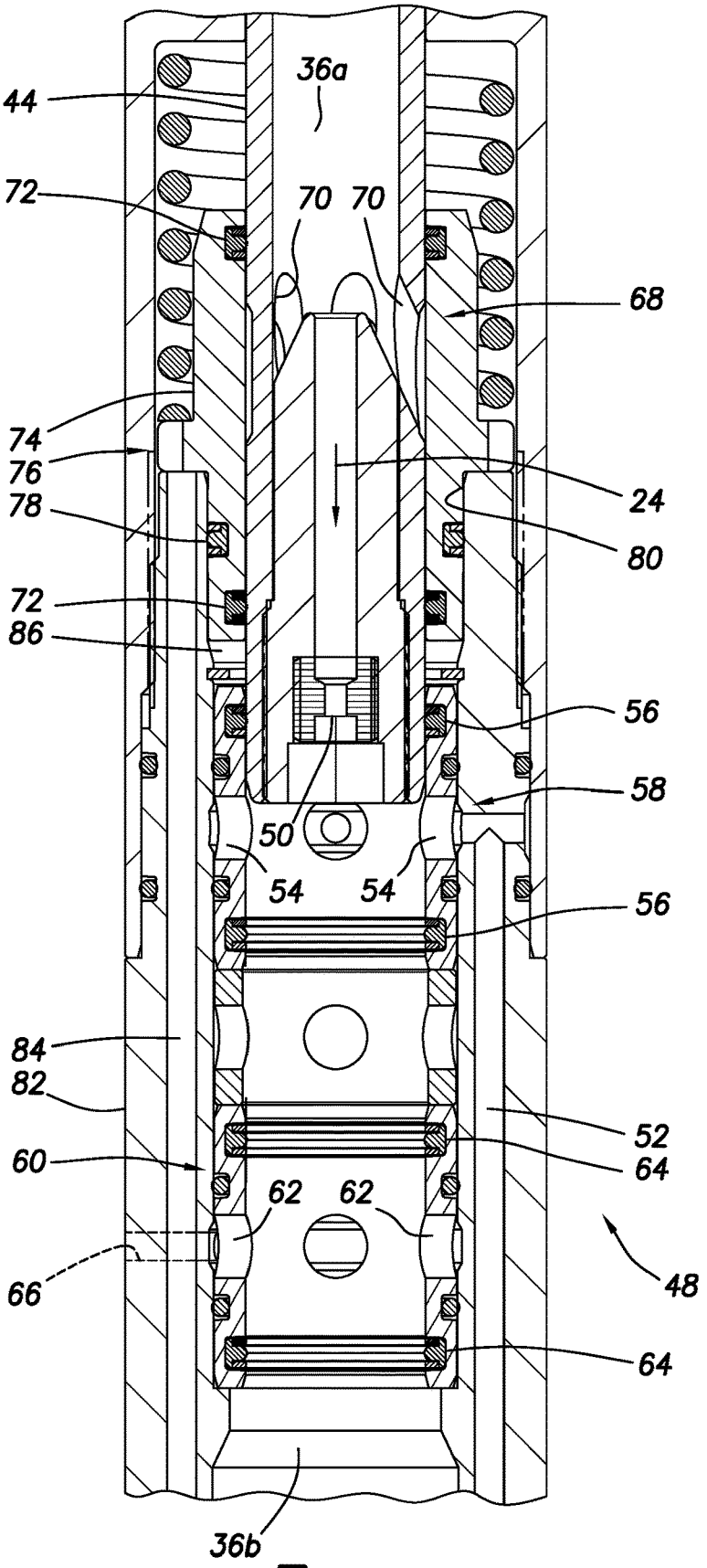
FIG. 4 is a representative cross-sectional view of a flow director portion of the flow controller in the deflate configuration.

Referring additionally now to FIGS. 3 & 4, cross-sectional views of the flow controller 34 and the flow director 48 are representatively illustrated apart from the remainder of the packer assembly 20. In FIGS. 3 & 4, the flow controller 34 is depicted in an example of the deflate configuration, in which the seal element 26 (not shown in FIGS. 3 & 4, see FIG. 2) is inwardly retracted and the packer assembly 20 can be conveyed into, displaced between locations in, or retrieved from, the wellbore 14.

To prevent a pressure differential from being created from the interior to the exterior of the seal element 26 in the deflate configuration, the inflation chamber 38 is placed in fluid communication with the lower flow passage section 36*b* via the flow director 48. In the FIGS. 3 & 4 example, a deflate flow path 52 is in communication with the inflation chamber 38, and is also placed in communication with the lower flow passage section 36*b* via ports 54 in the flow director 48 (see FIG. 4).

The ports 54 are positioned between internal seals 56 capable of sealingly engaging an exterior of the mandrel 44. With the mandrel 44 positioned as depicted in FIGS. 3 & 4, the ports 54 and the deflate flow path 52 are open for flow between the inflation chamber 38 and the lower flow passage section 36*b*.

If the mandrel 44 is displaced downward relative to the ports 54, so that the mandrel is sealingly engaged by both of the seals 56, the ports 54 and deflate flow path 52 will be closed to such flow. Thus, the ports 54, seals 56 and mandrel 44 comprise a valve 58 of the flow director 48 for selectively permitting and preventing flow through the deflate flow path 52 between the inflation chamber 38 and the lower flow passage section 36*b*.

Another valve 60 comprises ports 62, internal seals 64 and the mandrel 44. The ports 62 and a flow path 66 provide for fluid communication between the lower flow passage section 36*b* and the exterior of the packer assembly 20 above the seal element 26 (as viewed in FIG. 2).

In the deflate configuration of FIGS. 3 & 4, the valve 60 is open, thereby permitting flow through the ports 62 and flow path 66 between the lower flow passage section 36*b* and the exterior of the packer assembly 20 (e.g., the upper annulus section 30*a* in the FIG. 1 system 10). However, if the mandrel 44 is displaced sufficiently downward, so that both of the seals 64 sealingly engage the exterior of the mandrel, the ports 62 and flow path 66 will then be closed to such flow.

Another valve 68 comprises ports 70 formed through the mandrel 44 above the flow restrictor 50, and internal seals 72 carried in a poppet sleeve 74. In the FIGS. 3 & 4 deflate configuration, the valve 68 is closed, with flow through the ports 70 being prevented by the seals 72 and poppet sleeve 74.

Yet another valve 76 comprises the poppet sleeve 74 and an external seal 78 carried on the poppet sleeve. In the deflate configuration depicted in FIG. 4, the seal 78 is sealingly engaged in a seal bore 80 formed in a housing 82 of the flow director 48 and, thus, flow is prevented from the upper flow passage section 36*a* to an inflate flow path 84 in communication with the inflation chamber 38. In the deflate configuration, such flow is also prevented by the closed valve 68. Thus, fluid communication is permitted from the upper flow passage section 36*a* to the inflation chamber 38 via the inflate flow path 84 when the valves 68, 76 are open, and fluid communication between the upper flow passage section and the inflation chamber via the inflate flow path is prevented when either or both of the valves 68, 76 is closed (in this example, the valve 76 will not be open unless the valve 68 is open).

Note that the fluid flow 24 through the flow passage 36 creates a pressure differential across the flow restrictor 50. Specifically, with the fluid flow 24 in a downward direction as viewed in the drawings, the upper flow passage section 36*a* will have a greater pressure therein relative to pressure in the lower flow passage section 36*b*.

In this example, the flow restrictor 50 comprises a reduced diameter orifice. In other examples, other types of flow restrictors (such as, bluff bodies, surface textures, tortuous flow paths, etc.) may be used to produce the pressure differential in response to the fluid flow 24.

In the FIG. 1 system 10, the lower flow passage section 36*b* is in relatively unrestricted fluid communication with the annulus 30 external to the packer assembly 20. Thus, in this example, the pressure differential from the upper flow passage section 36*a* to the lower flow passage section 36*b* is substantially the same as a pressure differential from the upper flow passage section to the exterior of the packer assembly 20.

As described more fully below, this pressure differential can be used to inflate the seal element 26 by placing the inflation chamber 38 in communication with the upper flow passage section 36*a*. As discussed above, the valves 68, 76 are opened to permit such fluid communication. Displacement of the mandrel 44 downward relative to the poppet sleeve 74, so that the ports 70 are no longer positioned between the seals 72, will permit flow through the ports to a chamber 86 below the poppet sleeve 74.

The flow controller 34 includes the actuator 46 for producing such relative displacement of the mandrel 44. The actuator 46 includes a piston 88 with an upwardly facing piston area exposed to pressure in the upper flow passage section 36*a* via ports 90, and a downwardly facing piston area exposed to pressure external to the packer assembly 20 via ports 92. Thus, substantially the same pressure differential created across the flow restrictor 50 by the fluid flow 24 is also applied across the piston 88.

When the flow rate of the fluid flow 24 is increased to the predetermined level, a sufficient biasing force is created by the pressure differential acting across the piston 88, so that the actuator 46 displaces the mandrel 44 downward relative to the housing 82 of the flow director 48 (or, viewed differently, displaces the housing upward relative to the mandrel).

Figure 5:
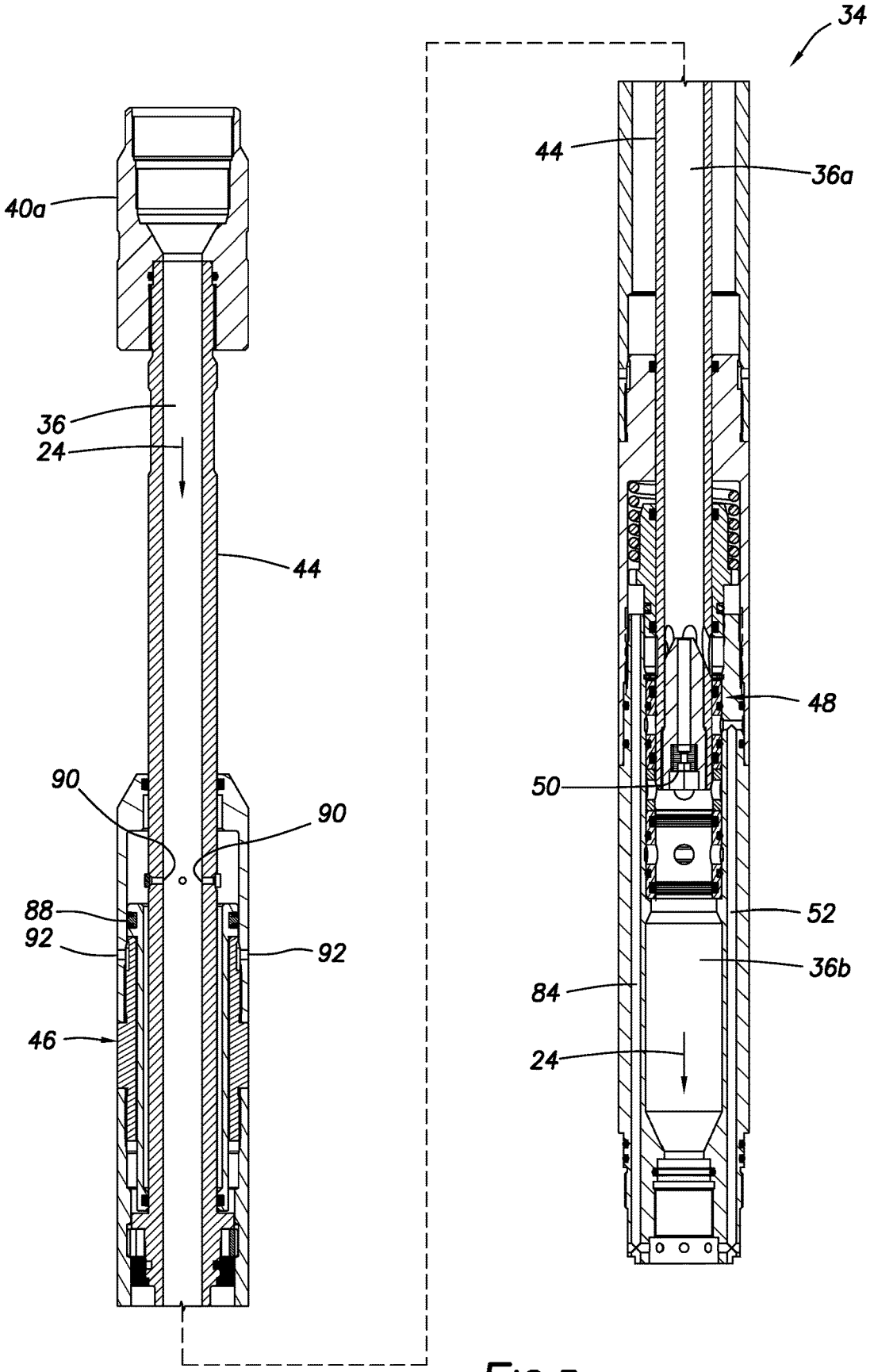
FIG. 5 is a representative cross-sectional view of the flow controller in an example of an inflate configuration.
Figure 6:
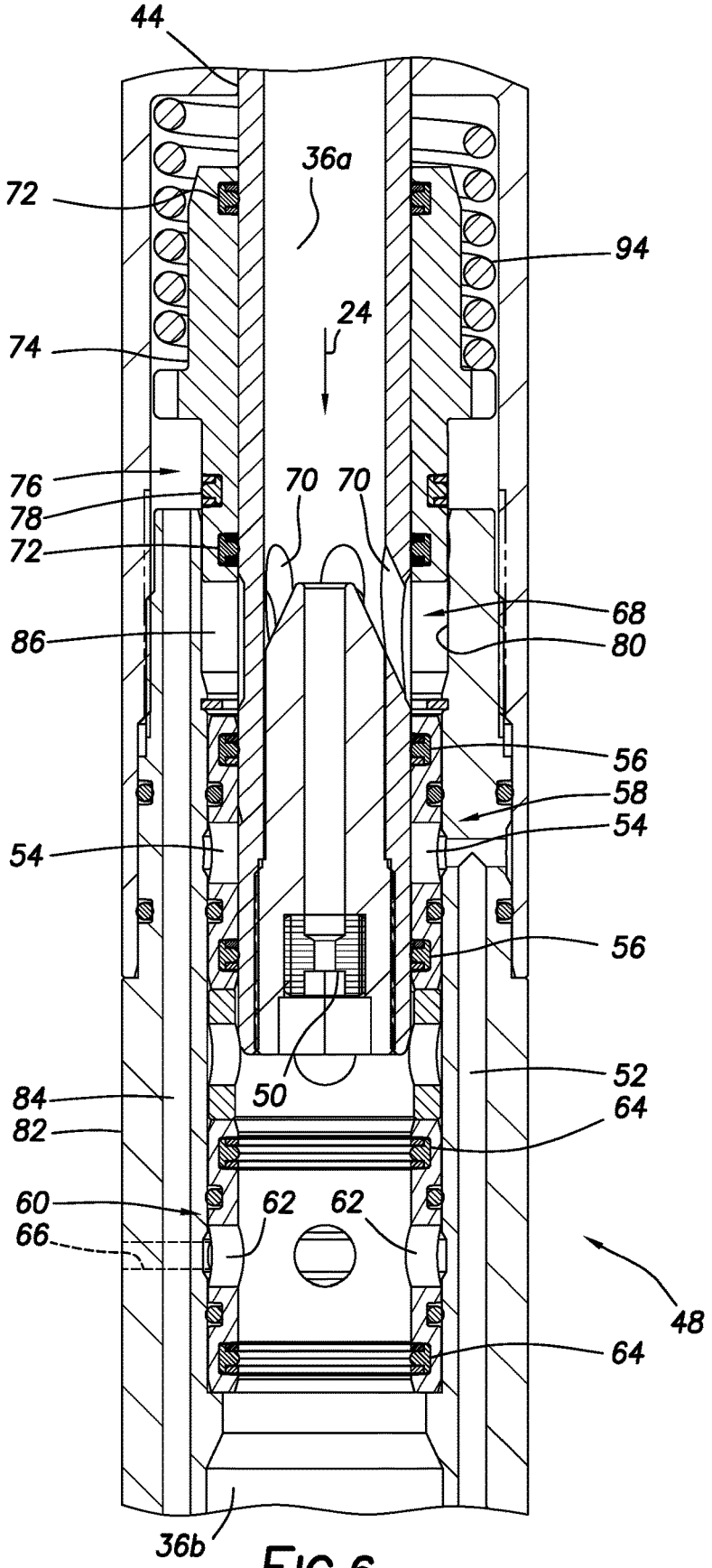
FIG. 6 is a representative cross-sectional view of the flow director in the inflate configuration.

Referring additionally now to FIGS. 5 & 6, cross-sectional views of the flow controller 34 and the flow director 48 are representatively illustrated in an example of the inflate configuration. In this configuration, the flow rate through the flow passage 36 has been increased to at least the predetermined level and, in response, the actuator 46 has displaced the housing 82 upward relative to the mandrel 44.

The valve 58 is now closed, with the mandrel 44 sealingly engaged with both of the seals 56. Fluid communication between the lower flow passage 36*b* and the inflation chamber 38 via the ports 54 and the flow path 52 is prevented.

The valve 68 is now open, permitting fluid communication between the upper flow passage section 36*a* and the chamber 86 below the poppet sleeve 74. This exposes a lower side of the poppet sleeve 74 to the pressure in the upper flow passage section 36*a*, while an upper side of the poppet sleeve is exposed to pressure in the seal element 26 via the flow path 84.

The poppet sleeve 74 is biased downward in this example by a biasing force exerted by a biasing device 94 (depicted as a compression spring in the drawings). When the pressure differential from the lower side to the upper side of the poppet sleeve 74 is great enough to overcome the biasing force exerted by the biasing device 94, the poppet sleeve will displace upward, at least until the seal 78 is no longer sealingly engaged in the seal bore 80. At that point, the valve 76 is opened, and fluid communication is permitted between the upper flow passage section 36*a* and the inflation chamber 38 via the ports 70, chamber 86 and flow path 84.

As described above in relation to FIGS. 3 & 4, in the deflate configuration the inflation chamber 38 is pressure equalized with the lower flow passage section 36*b*, which is also in fluid communication with the upper flow passage section 36*a* via the flow restrictor 50. In the FIGS. 5 & 6 inflate configuration, the inflation chamber 38 is no longer pressure equalized with the lower flow passage section 36*b*, but is instead in communication with the upper flow passage section 36*a*. At least a predetermined pressure differential is created from the upper flow passage section 36*a* to the lower flow passage section 36*b*, due to the increased flow rate through the flow restrictor 50.

The increased pressure communicated from the upper flow passage section 36*a* to the inflate flow path 84 will, thus, cause the seal element 26 to inflate and extend radially outward. In the FIG. 1 system 10, the seal element 26 when inflated extends radially outward and sealingly engages the well surface 28. Frictional contact between the inflated seal element 26 and the well surface 28 will also prevent, or at least inhibit, displacement of the packer assembly 20 relative to the well surface.

Note that the valve 76 is in some respects similar to a pressure relief valve, in that it opens only when the pressure differential across the poppet sleeve 74 (from the chamber 86 to the inflate flow path 84) is greater than a predetermined level. The predetermined level is determined by factors including a piston area of the poppet sleeve 74 and the biasing force exerted by the biasing device 94.

Thus, the valve 76 permits only one-way flow from the upper flow passage section 36*a* to the inflate flow path 84 in the inflate configuration. If the flow rate through the flow passage 36 is subsequently decreased, so that pressure in the upper flow passage section 36*a* decreases, the seal element 26 will not deflate, since the closed valve 76 will prevent release of pressure from the inflation chamber 38 to the upper flow passage section 36*a*.

The valve 60 remains open in the inflate configuration of FIGS. 5 & 6. Thus, fluid communication is permitted between the lower flow passage section 36*b* and the upper annulus 30*a* in the FIG. 1 system 10.

Figure 7:
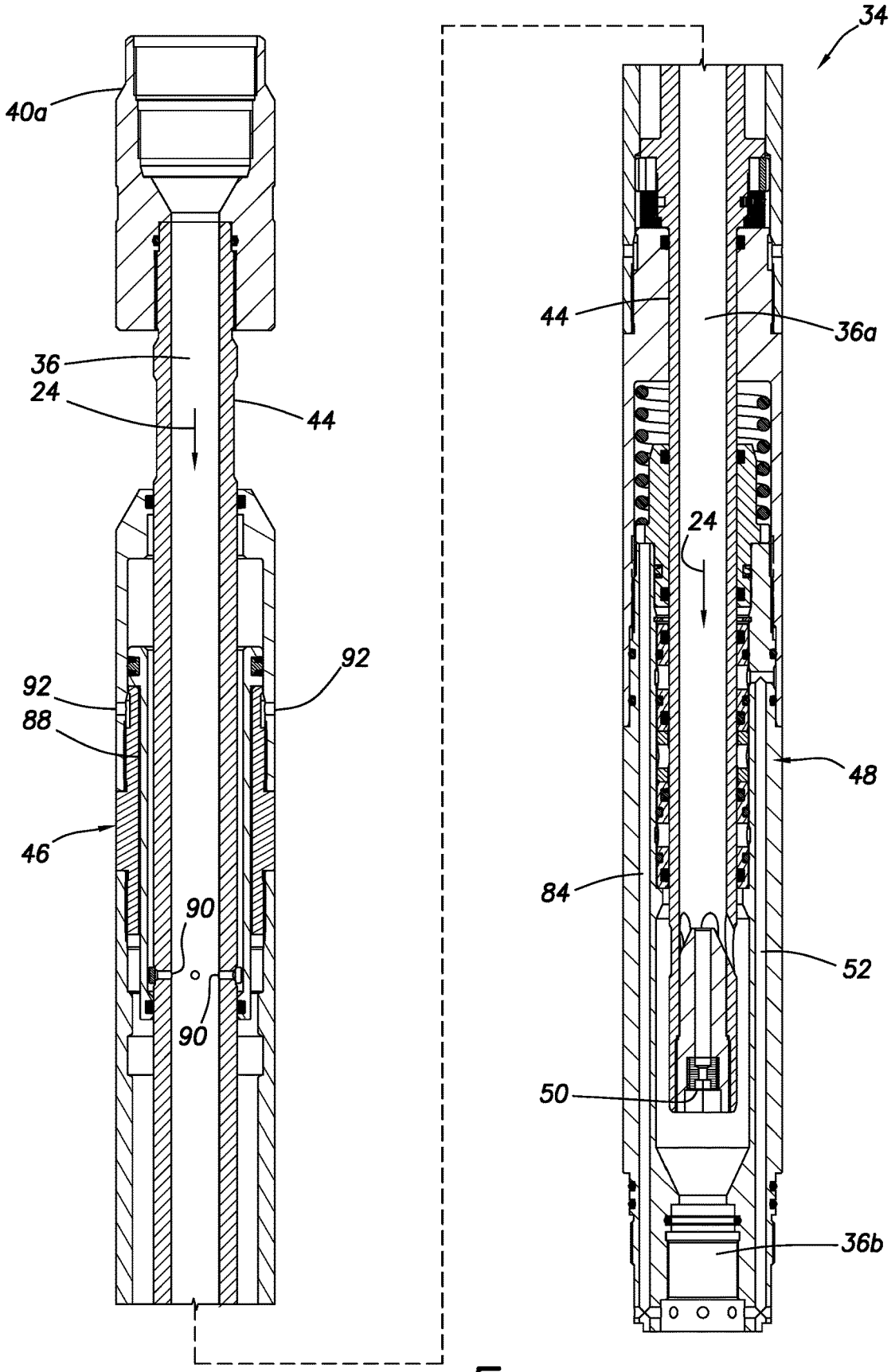
FIG. 7 is a representative cross-sectional view of the flow controller in an example of a set configuration.
Figure 8:
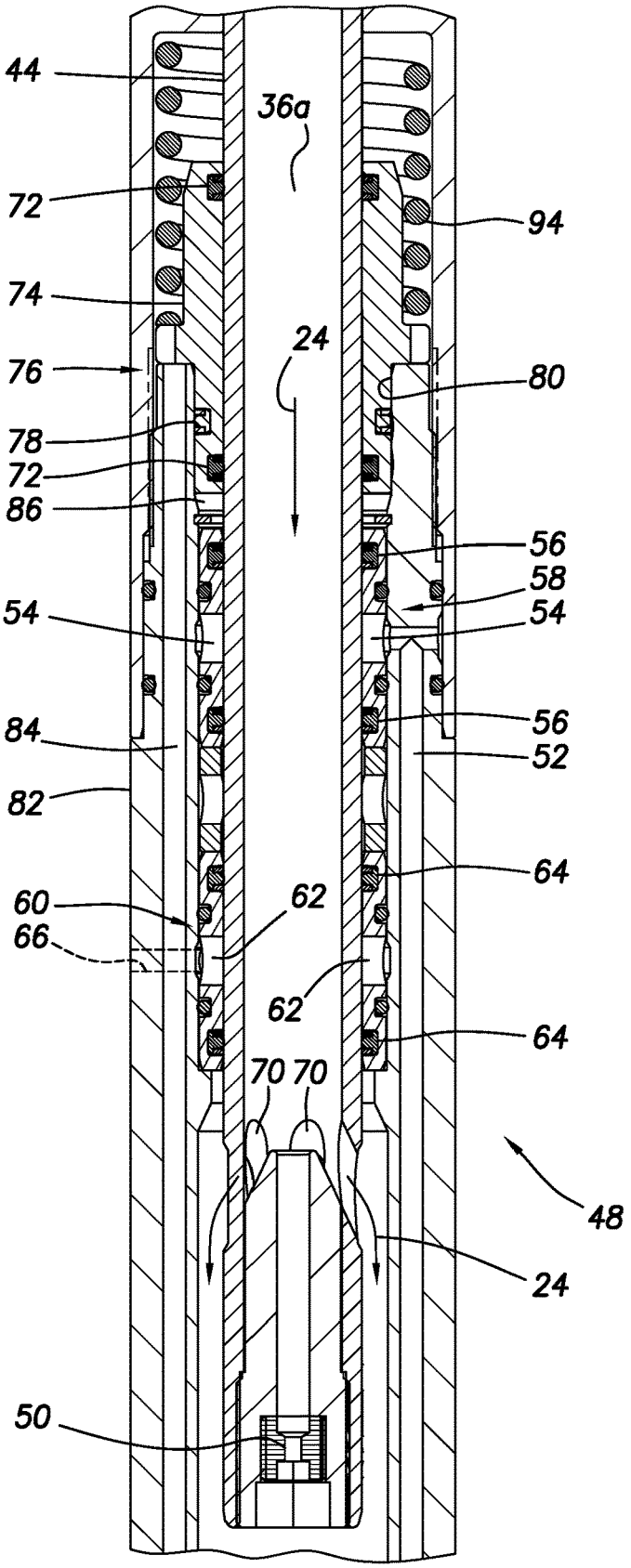
FIG. 8 is a representative cross-sectional view of the flow director in the set configuration.

Referring additionally now to FIGS. 7 & 8, cross-sectional views of the flow controller 34 and the flow director 48 are representatively illustrated in an example of the set configuration. In this configuration, the flow rate through the flow passage 36 has been decreased, and the flow controller 34 has been longitudinally compressed (for example, by slacking off on the tubular string 12 at the surface).

The longitudinal compression of the flow controller 34 causes the mandrel 44 to displace downward relative to the housing 82. The valves 58, 60, 76 are closed, and so the inflation chamber 38 is isolated from both of the upper and lower flow passage sections 36*a,b*.

Fluid communication is prevented between the inflation chamber 38 and the upper flow passage section 36*a* via the inflate flow path 84, and fluid communication is prevented between the inflation chamber 38 and the lower flow passage section 36*b* via the deflate flow path 52. Thus, fluid is prevented from being released from the inflation chamber 38, and the seal element 26 is thereby maintained in its inflated condition.

The valve 60 is closed in the set configuration of FIGS. 7 & 8. Thus, fluid communication is prevented between the lower flow passage section 36*b* and the upper annulus 30*a* in the FIG. 1 system 10.

Tests, treatments and other types of well operations can now be performed with the packer assembly 20 in its set configuration. In the FIG. 1 system 10, the seal element 26 isolates the upper annulus 30*a* from the lower annulus 30*b* in the set configuration.

Note that the ports 70 are positioned below the seals 64 in the set configuration, so that the fluid flow 24 can bypass the flow restrictor 50 (see FIG. 8). In this manner, the resistance to the fluid flow 24 through the flow passage 36 is substantially reduced.

The packer assembly 20 can be returned to its deflate configuration (see FIGS. 3 & 4) by longitudinally extending the flow controller 34 (e.g., by picking up on the tubular string 12 at the surface). In this manner, the mandrel 44 will be displaced upward in the flow director 48, until the valve 58 is opened (as depicted in FIG. 3). This places the inflation chamber 38 in fluid communication with the lower flow passage section 36*b*, thereby allowing pressure in the inflation chamber to vent into the lower flow passage section 36*b*.

The lower flow passage section 36*b* is also in communication with the upper annulus section 30*a* in the deflate configuration. In this manner, elevated pressure in the wellbore 14 below the packer assembly 20 can be vented to the upper annulus section 30*a*, and will not act to maintain the seal element 26 in its inflated condition (e.g., as might otherwise occur with the elevated pressure applied to the inflation chamber 38).

Note that the lower flow passage section 36*b* remains in fluid communication with the upper flow passage section 36*a* via the flow restrictor 50 in each of the deflate, inflate and set configurations of the packer assembly 20. The packer assembly 20 changes from the deflate configuration to the inflate configuration in response to a flow rate increase in the flow passage 36, the packer assembly changes from the inflate configuration to the set configuration in response to longitudinal compression of the flow controller 34, and the packer assembly changes from the set configuration to the deflate configuration in response to longitudinal extension of the flow controller. These configuration changes may be performed any number of times during a single trip of the packer assembly 20 into the wellbore 14.

It may now be fully appreciated that the above disclosure provides significant advances to the arts of designing, constructing and utilizing inflatable packer assemblies. In examples described above, the packer assembly 20 can be deflated downhole by venting the inflation chamber 38 to the lower flow passage section 36*b*, in a manner allowing the inflation chamber to be subsequently pressurized by producing a pressure differential across the flow restrictor 50.

The above disclosure provides to the art an inflatable packer assembly 20 for use in a subterranean well. In one example, the inflatable packer assembly 20 can include an inflatable seal element 26 having an internal inflation chamber 38, a flow passage 36 extending longitudinally through the inflatable packer assembly 20, a flow restrictor 50 between first and second sections 36*a,b* of the flow passage 36, and a flow controller 34 that selectively permits and prevents fluid communication between the inflation chamber 38 and each of the first and second flow passage sections 36*a,b*. The flow controller 34 changes from a deflate configuration to an inflate configuration in response to a flow rate increase through the flow passage 36.

The flow controller 34 may include first and second valves 68, 76, 58. The first valve 68, 76 prevents fluid communication between the inflation chamber 38 and the first flow passage section 36*a*, and the second valve 58 permits fluid communication between the inflation chamber 38 and the second flow passage section 36*b*, in the deflate configuration.

The first valve 68, 76 may permit fluid communication between the inflation chamber 38 and the first flow passage section 36*a*, and the second valve 58 may prevent fluid communication between the inflation chamber 38 and the second flow passage section 36*b*, in the inflate configuration.

The first valve 68, 76 may prevent fluid communication between the inflation chamber 38 and the first flow passage section 36*a*, and the second valve 58 may prevent fluid communication between the inflation chamber 38 and the second flow passage section 36*b*, in a set configuration.

The flow controller 34 may change from the inflate configuration to the set configuration in response to longitudinal compression of the flow controller 34. A resistance to flow from the first flow passage section 36*a* to the second flow passage section 36*b* may be reduced in response to the longitudinal compression of the flow controller 34.

The flow controller 34 may change from the set configuration to the deflate configuration in response to longitudinal extension of the flow controller 34.

Fluid communication may be permitted between the first and second flow passage sections 36*a,b* via the flow restrictor 50 in each of the deflate and inflate configurations.

The first flow passage section 36*a* may be placed in fluid communication with the inflation chamber 38 in response to the flow rate increase.

The first flow passage section 36*a* may be in communication with the inflation chamber 38 in the inflate configuration, the second flow passage section 36*b* may be in communication with the inflation chamber 38 in the deflate configuration, and the inflation chamber 38 may be isolated from the first and second flow passage sections 36*a,b* in a set configuration.

The flow controller 34 may change from the set configuration to the deflate configuration in response to longitudinal extension of the flow controller 34.

The first and second flow passage sections 36*a,b* may be in communication with each other in the deflate, inflate and set configurations.

A method of operating an inflatable packer assembly 20 in a subterranean well is also provided to the art by the above disclosure. In one example, the method can comprise connecting the inflatable packer assembly 20 in a tubular string 12, so that a longitudinal flow passage 36 of the tubular string 12 extends through the inflatable packer assembly 20, and a flow restrictor 50 restricts flow between first and second sections 36*a,b* of the flow passage 36; and inflating an inflatable seal element 26 of the inflatable packer assembly 20 while fluid flows from the first flow passage section 36*a* to the second flow passage section 36*b* via the flow restrictor 50.

The inflating step may include sealingly engaging the seal element 26 with a well surface 28, thereby isolating an upper annulus section 30*a* from a lower annulus section 30*b*. The upper annulus 30*a* may be in fluid communication with the second flow passage section 36*b* after the isolating step. The method may include deflating the seal element 26 while the upper annulus section 30*a* is in fluid communication with the second flow passage section 36*b*.

The method may include conveying the inflatable packer assembly 20 in the well while an inflation chamber 38 of the seal element 26 is in communication with the second flow passage section 36*b*.

The inflating step may include increasing a flow rate from the first flow passage section 36*a* to the second flow passage section 36*b*. The flow rate increasing step may include closing a flow path 52 between the second flow passage section 36*b* and an inflation chamber 38 of the seal element 26.

The method may include longitudinally extending the inflatable packer assembly 20, thereby opening the flow path 52 between the second flow passage section 36*b* and the inflation chamber 38.

A first flow path 84 between the first flow passage section 36*a* and an inflation chamber 38 of the seal element 26 may be open, and a second flow path 52 between the second flow passage section 36*b* and the inflation chamber 38 may be closed, in the inflating step. The method may include setting the inflatable packer assembly 20, with the first and second flow paths 84, 52 being closed in the setting step.

The method may include conveying the inflatable packer assembly 20 through the well, with the second flow path 52 being open in the conveying step.

The setting step may include longitudinally compressing the inflatable packer assembly 20. The setting step may include decreasing a restriction to flow from the first flow passage section 36*a* to the second flow passage section 36*b*.

A system 10 for use with a subterranean well is also described above. In one example, the system 10 can include a tubular string 12 having an inflatable packer assembly 20 connected therein, so that a flow passage 36 of the tubular string 12 extends longitudinally through the inflatable packer assembly 20. The inflatable packer assembly 20 is configured to block flow through an annulus 30 surrounding the tubular string 12 in response to inflation of a seal element 26 of the inflatable packer assembly 20. The inflatable packer assembly 20 includes a flow restrictor 50 between first and second sections 36*a,b* of the flow passage 36, a first selectively openable and closeable flow path 84 between the first flow passage section 36*a* and an inflation chamber 38 of the seal element 26, and a second selectively openable and closeable flow path 52 between the second flow passage section 36*b* and the inflation chamber 38.

The seal element 26 may separate an upper section 30*a* of the annulus 30 from a lower section 30*b* of the annulus 30 in a set configuration of the inflatable packer assembly 20. The first and second flow paths 84, 52 are closed in the set configuration.

The upper annulus section 30*a* may be in communication with the second flow passage section 36*b* in a deflate configuration of the inflatable packer assembly 20.

The second flow path 52 may be open in the deflate configuration. The first flow path 84 may be closed in the deflate configuration.

The first flow path 84 may be open in an inflate configuration of the inflatable packer assembly 20. Fluid communication may be permitted between the first and second flow passage sections 36*a,b* in the inflate configuration.

The first flow path 84 may open in response to an increase in flow rate from the first flow passage section 36*a* to the second flow passage section 36*b*.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An inflatable packer assembly for use in a subterranean well, the inflatable packer assembly comprising:

an inflatable seal element with an internal inflation chamber;

a flow passage extending longitudinally through the inflatable packer assembly;

a flow restrictor between first and second sections of the flow passage; and a flow controller that selectively permits and prevents fluid communication between the inflation chamber and each of the first and second flow passage sections, and the flow controller is changeable from a deflate configuration to an inflate configuration in response to a flow rate increase through the flow restrictor.

2. The inflatable packer assembly of claim 1, in which fluid communication is permitted between the first and second flow passage sections via the flow restrictor in each of the deflate and inflate configurations.

3. The inflatable packer assembly of claim 1, in which the first flow passage section is placed in fluid communication with the inflation chamber in response to the flow rate increase.

4. The inflatable packer assembly of claim 1, in which the first flow passage section is in communication with the inflation chamber in the inflate configuration, the second flow passage section is in communication with the inflation chamber in the deflate configuration, and the inflation chamber is isolated from the first and second flow passage sections in a set configuration.

5. The inflatable packer assembly of claim 4, in which the flow controller changes from the set configuration to the deflate configuration in response to longitudinal extension of the flow controller.

6. The inflatable packer assembly of claim 4, in which the first and second flow passage sections are in communication with each other in the deflate, inflate and set configurations.

7. A method of operating an inflatable packer assembly in a subterranean well, the method comprising:

connecting the inflatable packer assembly in a tubular string, so that a longitudinal flow passage of the tubular string extends through the inflatable packer assembly, and a flow restrictor restricts flow between first and second sections of the flow passage; and inflating an inflatable seal element of the inflatable packer assembly while fluid flows from the first flow passage section to the second flow passage section via the flow restrictor, in which a first flow path between the first flow passage section and an inflation chamber of the seal element is open, and a second flow path between the second flow passage section and the inflation chamber is closed, in the inflating.

8. The method of claim 7, further comprising conveying the inflatable packer assembly in the well while an inflation chamber of the seal element is in communication with the second flow passage section.

9. The method of claim 7, in which the inflating comprises increasing a flow rate from the first flow passage section to the second flow passage section.

10. The method of claim 9, in which the flow rate increasing comprises closing a flow path between the second flow passage section and an inflation chamber of the seal element.

11. The method of claim 10, further comprising longitudinally extending the inflatable packer assembly, thereby opening the flow path between the second flow passage section and the inflation chamber.

12. The method of claim 7, further comprising setting the inflatable packer assembly, first and second flow paths being closed in the setting.

13. The method of claim 12, further comprising conveying the inflatable packer assembly through the well, and in which the second flow path is open in the conveying.

14. A system for use with a subterranean well, the system comprising:

a tubular string having an inflatable packer assembly connected therein, so that a flow passage of the tubular string extends longitudinally through the inflatable packer assembly, the inflatable packer assembly being configured to block flow through an annulus surrounding the tubular string in response to inflation of a seal element of the inflatable packer assembly;

the inflatable packer assembly including a mandrel, the mandrel including a flow restrictor which restricts flow between first and second sections of the flow passage, in which relative displacement between the mandrel and an outer housing of the inflatable packer assembly occurs in response to an increase in fluid flow through the flow restrictor; and the inflatable packer assembly further including a first selectively openable and closeable flow path between the first flow passage section and an inflation chamber of the seal element, and a second selectively openable and closeable flow path between the second flow passage section and the inflation chamber.

15. The system of claim 14, in which the seal element separates an upper section of the annulus from a lower section of the annulus in a set configuration of the inflatable packer assembly, the first and second flow paths being closed in the set configuration.

* * * * *